US007852185B2

(12) United States Patent
Gardner et al.

(10) Patent No.: US 7,852,185 B2
(45) Date of Patent: Dec. 14, 2010

(54) ON-DIE MICRO-TRANSFORMER STRUCTURES WITH MAGNETIC MATERIALS

(75) Inventors: Donald S. Gardner, Mountain View, CA (US); Peter Hazucha, Beaverton, OR (US); Gerhard Schrom, Hillsboro, OR (US)

(73) Assignee: Intel Corporation, Santa Clara, CA (US)

( * ) Notice: Subject to any disclaimer, the term of this patent is extended or adjusted under 35 U.S.C. 154(b) by 1993 days.

(21) Appl. No.: 10/430,508

(22) Filed: May 5, 2003

(65) Prior Publication Data

US 2004/0222492 A1 Nov. 11, 2004

(51) Int. Cl.
*H01F 5/00* (2006.01)

(52) U.S. Cl. ..... 336/200

(58) Field of Classification Search ..... 257/531; 336/65, 83, 200, 232

See application file for complete search history.

(56) References Cited

U.S. PATENT DOCUMENTS

| | | | |
|---|---|---|---|
| 3,607,462 | A | 9/1971 | Laing |
| 3,881,244 | A | 5/1975 | Kendall |
| 3,905,883 | A | 9/1975 | Hanazono et al. |
| 4,543,553 | A | 9/1985 | Mandai et al. |
| 4,791,719 | A | 12/1988 | Kobayashi et al. |
| 4,797,648 | A | 1/1989 | Kaneko et al. |
| 4,816,784 | A | 3/1989 | Rabjohn |
| 4,884,156 | A | 11/1989 | Miyakawa et al. |
| 4,959,631 | A | 9/1990 | Hasegawa et al. |
| 5,047,296 | A | 9/1991 | Miltenberger et al. |
| 5,095,357 | A | 3/1992 | Andoh et al. |
| 5,121,852 | A | 6/1992 | Wilkes |
| 5,169,713 | A | 12/1992 | Kumurdjian |
| 5,221,459 | A | 6/1993 | Okano et al. |
| 5,420,558 | A | 5/1995 | Ito et al. |
| 5,446,311 | A | 8/1995 | Ewen et al. |
| 5,469,399 | A | 11/1995 | Sato et al. |
| 5,530,415 | A | 6/1996 | Takaya |
| 5,583,474 | A | 12/1996 | Mizoguchi et al. |
| 5,609,946 | A | 3/1997 | Korman et al. |

(Continued)

FOREIGN PATENT DOCUMENTS

| | | |
|---|---|---|
| DE | 4117878 | 12/1991 |

(Continued)

OTHER PUBLICATIONS

United States Patent Application entitled Integrated Inductor, Inventor: Donald S. Gardner.

(Continued)

*Primary Examiner*—Tuyen Nguyen
(74) *Attorney, Agent, or Firm*—Schwegman, Lundberg & Woessner, P.A.

(57) ABSTRACT

A transformer integrated on a die, the transformer comprising a set of conductive lines formed on the die within one layer and interconnected among each other so that no two lines belonging to any one winding are nearest neighbors. The set of conductive lines is surrounded by a magnetic material, which may be amorphous CoZrTa, CoFeHfO, CoAlO, FeSiO, CoFeAlO, CoNbTa, CoZr, and other amorphous cobalt alloys. The transformer may be operated at frequencies higher than 10 MHz and as high as 1 GHz, with relatively low resistance and relatively high magnetic coupling between the windings.

30 Claims, 6 Drawing Sheets

U.S. PATENT DOCUMENTS

| | | | | |
|---|---|---|---|---|
| 5,635,892 | A | 6/1997 | Ashby et al. | |
| 5,694,030 | A | 12/1997 | Sato et al. | |
| 5,705,287 | A | 1/1998 | Doerner et al. | |
| 5,781,071 | A | 7/1998 | Kusunoki | |
| 5,801,100 | A | 9/1998 | Lee et al. | |
| 5,834,825 | A | 11/1998 | Imai | |
| 5,877,533 | A | 3/1999 | Arai et al. | |
| 5,892,425 | A | 4/1999 | Kuhn et al. | |
| 5,920,979 | A * | 7/1999 | Nepela et al. | 29/603.13 |
| 5,930,415 | A | 7/1999 | Pham | |
| 5,952,704 | A | 9/1999 | Yu et al. | |
| 5,961,746 | A | 10/1999 | Nepela | |
| 5,976,715 | A | 11/1999 | Chen et al. | |
| 6,031,445 | A | 2/2000 | Marty et al. | |
| 6,033,782 | A | 3/2000 | Hubbard et al. | |
| 6,037,649 | A | 3/2000 | Liou | |
| 6,040,226 | A | 3/2000 | Wojnarowski et al. | |
| 6,067,002 | A | 5/2000 | Fujino et al. | |
| 6,103,136 | A | 8/2000 | Han | |
| 6,114,937 | A | 9/2000 | Burghartz et al. | |
| 6,121,852 | A | 9/2000 | Mizoguchi et al. | |
| 6,166,422 | A | 12/2000 | Qian et al. | |
| 6,191,495 | B1 | 2/2001 | Kossives et al. | |
| 6,194,987 | B1 | 2/2001 | Zhou et al. | |
| 6,201,287 | B1 | 3/2001 | Forbes | |
| 6,207,303 | B1 | 3/2001 | Tomita | |
| 6,240,621 | B1 | 6/2001 | Nellissen et al. | |
| 6,281,560 | B1 | 8/2001 | Allen et al. | |
| 6,291,305 | B1 | 9/2001 | Huang et al. | |
| 6,392,524 | B1 | 5/2002 | Biegelsen et al. | |
| 6,404,317 | B1 * | 6/2002 | Mizoguchi et al. | 336/200 |
| 6,414,564 | B1 * | 7/2002 | Mizoguchi et al. | 333/35 |
| 6,433,299 | B1 * | 8/2002 | Varshney | 219/121.47 |
| 6,441,715 | B1 | 8/2002 | Johnson | |
| 6,452,247 | B1 | 9/2002 | Gardner | |
| 6,593,841 | B1 | 7/2003 | Mizoguchi et al. | |
| 6,597,593 | B1 * | 7/2003 | Cruz et al. | 363/147 |
| 6,838,863 | B2 * | 1/2005 | Hazucha et al. | 323/282 |
| 6,856,228 | B2 | 2/2005 | Gardner | |
| 6,870,456 | B2 | 3/2005 | Gardner | |
| 6,891,461 | B2 | 5/2005 | Gardner | |
| 2001/0052837 | A1 | 12/2001 | Walsh | |
| 2003/0001709 | A1 | 1/2003 | Visser | |
| 2003/0001713 | A1 | 1/2003 | Gardner | |
| 2007/0001762 | A1 | 1/2007 | Schrom et al. | |

FOREIGN PATENT DOCUMENTS

| | | | |
|---|---|---|---|
| EP | 0295028 | A1 | 12/1988 |
| EP | 0725407 | A1 | 8/1996 |
| EP | 0884783 | A2 | 12/1998 |
| FR | 2369694 | | 5/1978 |
| JP | 61-20311 | | 1/1986 |
| JP | 3-214411 | | 9/1991 |
| JP | 5-081615 | | 4/1993 |
| JP | 6-124843 | | 5/1994 |
| JP | 7-272932 | | 10/1995 |
| JP | 2000082621 | | 3/2000 |
| TW | 378417 | | 1/2000 |
| TW | 386310 | | 4/2000 |
| TW | 411481 | | 11/2000 |

OTHER PUBLICATIONS

United States Patent Application entitled Integrated Transformer, Inventor: Donald S. Gardner.

"International Search Report for corresponding PCT Application No. PCT/US2004/011420", (Oct. 27, 2004), 6 pgs.

Baba, M., "GHz-Drive Magnetic Thin-Film Inductor Using CoNbZr Film", *Journal of the Magnetics Society of Japan*, 24(4-2), (2000),879-882.

Brandon, E., "Microinductors for Sacecraft Power Eectronics", *6th International Symposium, Magnetic Materials, Processes and Device VI Applications to Storage and Microelectromechanical systems (MEMS)*, vol. 2000-29, The Electrochemical Society, Inc., Pennington, New Jersey,(2001),559-567.

Fessant, A., et al., "Influence of In-Plane Anisotropy and Eddy Currents on the Frequency Spectra of the Complex Permeability of Amorphous CoZr Thin Films", *IEEE Transactions on Magnetics*, 29(1), (Jan. 1993),82-87.

Gardner, D., "High Frequency (GHz) and Low Resistance Integrated Inductors Using Magnetic Materials", *Proceedings of the IEEE 2001 International Interconnect Technology Conference*, (Jun. 2001), 101-103.

Gardner, D., "Mechanical Stress as a Function of Temperature for Aluminum Alloy Films", *Journal of Applied Physics*, 67(4), (Feb. 15, 1990), 1831-1845.

Kobayashi, Y., "New Type Micro Cloth-Inductor and Transformer With Thin Amorphous Wires and Multi-Thin Coils", *IEEE Transactions on Magnetics*, 28(5), (Sep. 1992),3012-3014.

Korenivski, V., "Magnetic Film Inductors for Radio Frequency Applications", *Journal of Applied Physics*, 82(10), (Nov. 15, 1997),5247-5254.

Long, J., "The Modeling, Characterization, and Design of Monolithic Inductors for Silicon RF IC's", *IEEE Journal of Solid-State Circuits*, 32(2), (Mar. 1997), 357-369.

Matsuki, H., "A New Cloth Inductor Using Amorphous Fiber", *IEEE Transactions on Magnetics*, 21(5), (Sep. 1985), 1738-1740.

Matsumoto, S., "Integration of a Power Supply for System-on-Chip", *IEICE Transactions on Fundamentals of Electronics, Communications and Computer Sciences*, vol. E80-A, No. 2, (Feb. 1997), 276-282.

Mino, M., et al., "A New Planar Microtransformer for Use in Micro-Switching Converters", *IEEE Transactions on Magnetics*, 28(4), (Jul. 1992), 1969-1973.

Mino, M., et al., "Planar Microtransformer With Monolithically-Integrated Rectifier Diodes for Micro-Switching Converters", *IEEE Transactions on Magnetics*, 32(2), Mar. 1996, 291-296.

Mohan, S., "Bandwidth Extension in CMOS With Optimized On-Chip Inductors", *IEEE Journal of Solid-State Circuits*, 35(3), (Mar. 2000), 346-355.

Mohan, S., "Simple Accurate Expressions for Planar Spiral Inductances", *IEEE Journal of Solid-State Circuits*, 34(10), (Oct. 1999), 1419-1424.

Niknejad, A., "Analysis, Design, and Optimization of Spiral Inductors and Transformers Si RF IC's", *IEEE Journal of Solid-State Circuits*, 33(10), (Oct. 1998),1470-1481.

O'Donnell, T., "Microtransformers and Inductors using Permalloy Thin Films", *Preparation, Properties, and Applications of Thin Ferromagnetic Films*, http://www.iemw.tuwien.ac.at/publication/workshop0600/ODonnell.html, (Jun. 2000), 45-52.

Oshiro, O., et al., "A Novel Minature Planar Inductor", *IEEE Transactions on Magnetics*, vol. Mag-23, No. 5, (1987),3759-3761.

Park, J. Y., et al., "Batch-Fabricated Microinductors With Electroplated Magnetically Anisotropic and Laminated Alloy Cores", *IEEE Transactions on Magnetics*, 35(5), (Sep. 1999),4291-4300.

Sato, T., "New Applications Nanocrystalline Fe(Co-Fe)Hf-O Magnetic Films to micromagnetic devices", *Journal of Applied Physics*, 83(11), (Jun. 1, 1998),6658-6660.

Shirakawa, K., "Thin Film Cloth-Structured Inductor for Magnetic Integrated Circuit", *IEEE Transactions on Magnetics*, 26(5), (Sep. 1990), 2262-2264.

Tomita, H., "Oblique-Field Annealing Effect for In-Plane Magnetic Anisotropy of Soft Magnetic Co-Nb-Zr Thin Films", *IEEE Transactions on Magnetics*, 30(3), (May 1994),1336-1339.

Yabukami, S., "Noise Analysis of a MHz-3 GHz Magnetic Thin Film Permeance Meter", *Journal of Applied Physics*, 85(8), (Apr. 15, 1999), 5148-5150.

Yamaguchi, M. , "1 GHz-drive magnetic thin-film inductors for RF integrated circuits using micro-patterned granular film", *Digest of INTERMAG 99. 1999 IEEE International Magnetics Conference*, 1999, (May 18-21, 1999), ED01-ED01.

Yamaguchi, M., "Chapter 5. Magnetic Films for Planar Inductive Components and Devices", *In: Handbook of Thin Film Devices, vol. 4—Magnetic Thin Film Devices*, Adam, J. D., et al., Editors, Academic Press, (2000), 185-212.

Yamaguchi, M. , "Characteristics of Magnetic Thin-Film Inductors at Large Magnetic Field", *IEEE Transactions on Magnetics*, 31(6), (Nov. 1995), 4229-4231.

Yamaguchi, M., "Magnetic Thin-Film Inductor for rf Integrated Circuits", *Extended Abstracts of the 1999 International Conference on Solid-State Devices and Materials*, Tokyo, (1999), 580-581.

Yamaguchi, M., "Microfabrication and Characteristics of Magnetic Thin-Film Inductors in the Ultra High Frequency Region", *Journal of Applied Physics*, 85(11), (Jun. 1, 1999), 7919-7922.

Yue, C., "On-Chip Spiral Inductors With Patterned Ground Shields for Si-Based RF IC's", *IEEE Jorunal of Solid-State Circuits*, 33(5), (May 1998),743-752.

Co-pending ROC Application No. 93111253 Official Letter and English translation bearing May 4, 2005 date of receipt.

"Office Action received Mar. 22, 2006", Taiwan Application No. 93111253, 2 pgs.

* cited by examiner

ON-DIE MICRO-TRANSFORMER STRUCTURES WITH MAGNETIC MATERIALS

FIELD

The present invention relates to transformers, and more particularly, to transformers that may be integrated on a die.

BACKGROUND

Transformers are used in many different types of power distribution systems, such as in switched voltage converters. An example of a switched voltage converter utilizing a transformer is the diagonal half-bridge flyback converter of FIG. 1. In a first portion of a switching cycle, both transistors 102 and 104 are ON and store energy in the magnetic field of transformer 106. All the diodes are OFF, i.e., reverse-biased. In a second (flyback) portion of a switching cycle, the energy previously stored in the transformer magnetic field is released to output capacitor 108 via output diode 110. Any excess energy will be returned to input capacitor 112 via input diodes 114 and 116, which also limits the voltage stress on switching transistors 102 and 104. The duty cycle depends on the transformer turn ratio (i.e. voltage conversion ratio). Controller 118 adjusts the switching frequency to regulate the amount of energy provided to load 120, so that the sensed voltage $V_S$ is close to reference voltage $V_{ref}$. For a small load, the switching frequency is high. For a large load, the switching frequency is low. The coupling factor between the input and output windings of transformer 106 determines how much of the stored magnetic energy is released to the output in the second (flyback) portion of switching cycle. Low coupling factor results in poor efficiency.

The flyback converter of FIG. 1 is just one example of a switched voltage converter making use of a transformer. In many applications requiring a DC-to-DC converter, such as portable systems utilizing microprocessors, switched voltage converters may be more desirable than other types of voltage converters or regulators, such as linear voltage regulators, because they can be made more efficient. In a linear voltage regulator, the power conversion efficiency is always less than $V_S/V_D$, whereas in a switching converter, the efficiency is typically 80-95%.

Transformers find applications in power distribution systems other than the flyback converter, which is just one example. There are advantages to integrating a power distribution system on the same die as the circuits that are powered by the power distribution system. For example, as processor technology scales to smaller dimensions, supply voltages to circuits within a processor will also scale to smaller values. But for many processors, power consumption has also been increasing as technology progresses. Using an off-die voltage converter to provide a small supply voltage to a processor with a large power consumption leads to a large total electrical current being supplied to the processor. This can increase the electrical current per pin, or the total number of pins needed. Also, an increase in supply current can lead to an increase in resistive as well as inductive voltage drop across various off-die and on-die interconnects, and to a higher cost for decoupling capacitors. Integrating the voltage converter onto the die would mitigate these problems because a higher input voltage with lower current could be provided to the die by an off-die power supply, and the reduction of the higher input voltage to lower, regulated voltages could be done on the die closer to the circuits that require the regulated voltages.

DESCRIPTION OF EMBODIMENTS

Figure 1:
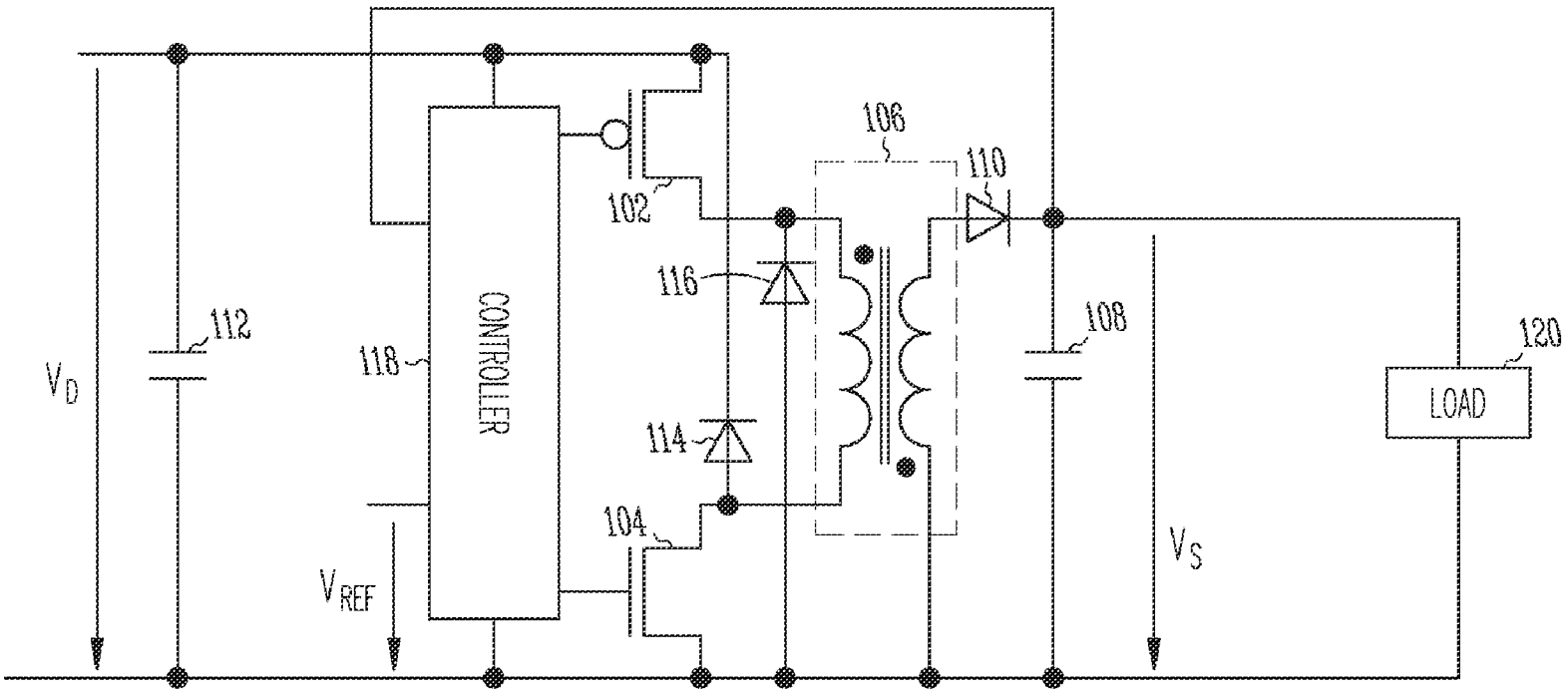
Fig. 1 (Prior Art)
FIG. 1 is a diagonal half-bridge flyback converter.
Figure 2:
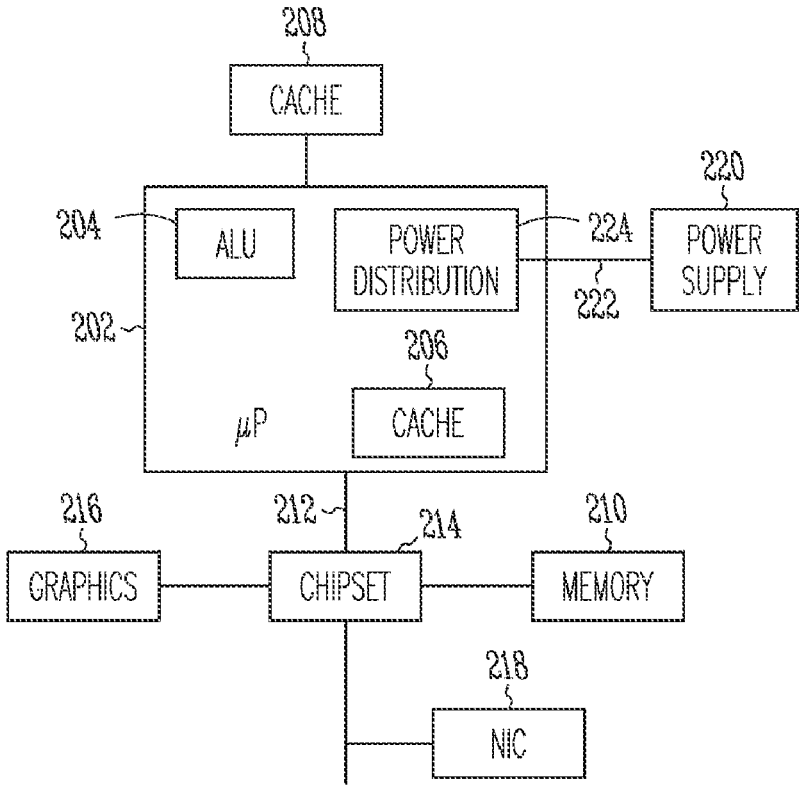
FIG. 2 is a computer system utilizing an embodiment of the present invention.

Embodiments of the present invention may be integrated on a processor, or used in computer systems, such as that shown in FIG. 2. In FIG. 2, microprocessor die 202 comprises many sub-blocks, such as arithmetic logic unit (ALU) 204 and on-die cache 206. Microprocessor 202 may also communicate to other levels of cache, such as off-die cache 208. Higher memory hierarchy levels, such as system memory 210, are accessed via host bus 212 and chipset 214. In addition, other off-die functional units, such as graphics accelerator 216 and network interface controller (NIC) 218, to name just a few, may communicate with microprocessor 202 via appropriate busses or ports.

Power supply 220 provides an input supply voltage to on-die power distribution system 224 via power bus 222. Power supply 220 may provide power to other modules, but for simplicity such connections are not shown. Embodiments of the present invention provide transformers that may be utilized in on-die power distribution system 224.

For a transformer to be small enough to be integrated on a die, it is proposed that its operating frequency, for example the frequency of controller 108, be sufficiently high and that magnetic material suitable for high frequency operation be used to increase coupling between the windings of the transformer. For some embodiments, it is proposed that the magnetic material is chosen from the group consisting of amorphous CoZrTa, CoFeHfO, CoAlO, FeSiO, CoFeAlO, CoNbTa, CoZr, and other amorphous cobalt alloys. An amorphous alloy used in a particular embodiment may comprise various atomic percentages of its constituent elements. For example, a particular embodiment using the amorphous cobalt alloy CoZrTa may have 4% Zr, 4.5% Ta, with the rest being Co. For some other embodiments using CoZrTa, the range for Zr may be from 3% to 12% and the range for Ta may be from 0% to 10%. Other embodiments may use the cobalt alloy CoFeHfO, with 19.1% Fe, 14.5% Hf, and 22.1% O, or the Cobalt alloy CoFeAlO, with 51.1% Co, 21.9% Fe, and 27% Al. These merely serve as particular examples. The use of such magnetic material allows for operating frequencies of 10 MHz to 1 GHz, and higher. However, other magnetic material may be used in other embodiments.

Figure 3A:
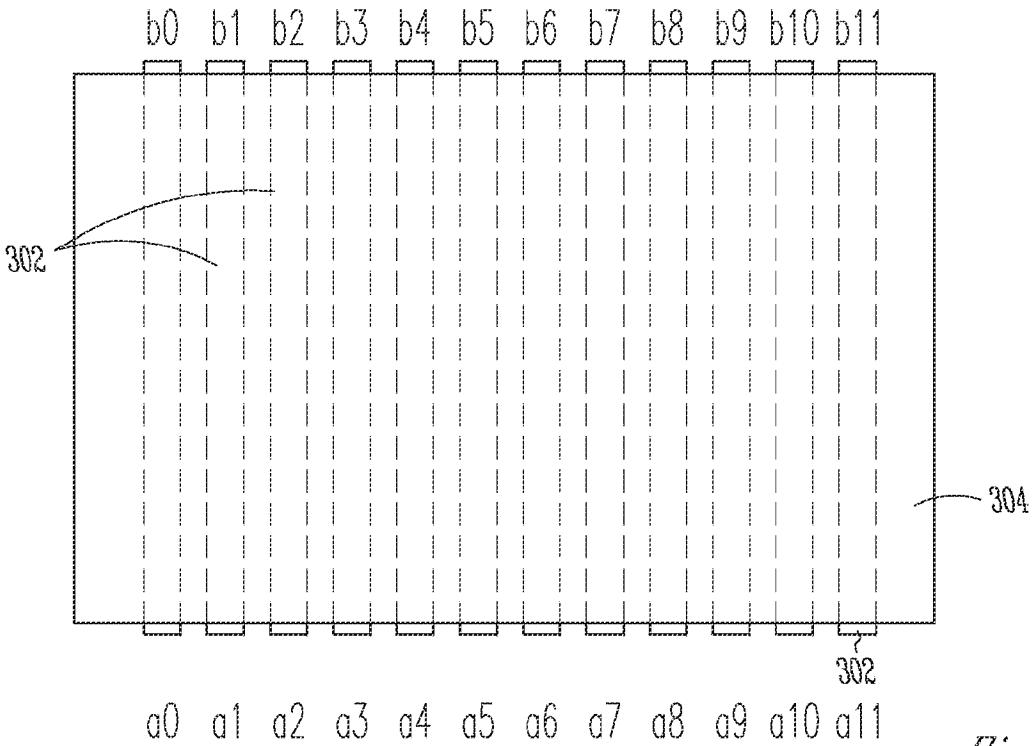
FIGS. 3*a* and 3*b* illustrate the geometry of a transformer according to an embodiment of the present invention.

The geometry or structure of a transformer according to embodiments of the present invention is illustrated in FIG. 3*a*. FIG. 3*a* provides a simplified top view of a transformer integrated on a die. In one layer, lines (conductors) 302 in FIG. 3*a* are formed parallel to each other by standard silicon processing techniques. Magnetic material 304 is deposited above and below parallel lines 302, and around the leftmost and rightmost parallel lines to form a closed magnetic circuit (see FIG. 3*b*), so as to provide a large inductance and magnetic coupling among the lines. This increases magnetic coupling between the windings of the transformer for a given size of transformer. For simplicity, FIG. 3*a* shows magnetic material 304 only above lines 302.

Figure 3B:
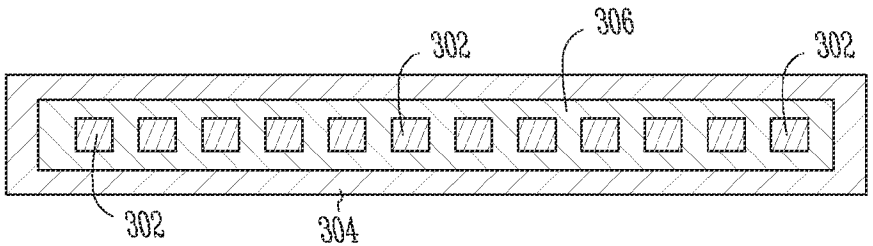
Figure 3C:
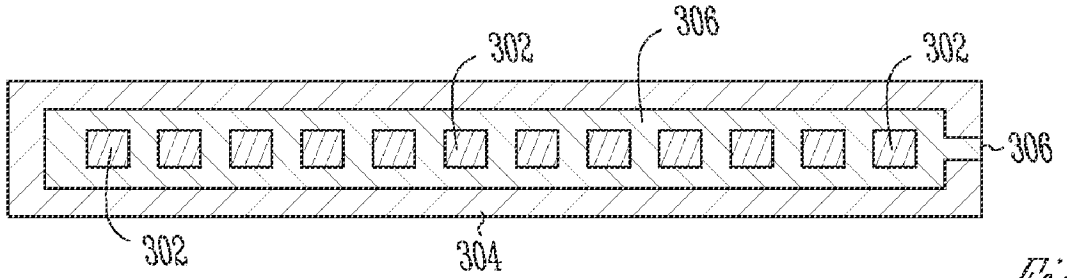
FIG. 3*c* illustrates the geometry of a transformer according to another embodiment of the present invention.

FIG. 3*b* provides a simplified cross-sectional view of a transformer according to embodiments of the present invention. Lines 302 in FIG. 3*b* are insulated from each other and from magnetic material 304 by insulator 306, which may be $SiO_2$, for example. As discussed above, magnetic material 304 in FIG. 3*b* is seen to be deposited both below and above lines 302, as well as around the leftmost and rightmost lines. In other embodiments, a small gap may be fabricated between the top and bottom magnetic layers. For example, FIG. 3*c* shows a gap 306 in magnetic material 304 near the rightmost (with respect to the perspective view) line so that magnetic layer 306 does not completely surround lines 302. Other embodiments may have a gap in the magnetic material near both the leftmost and rightmost lines. This results in a higher saturation current.

Insulating material 306 deposited around lines 302, and in any end gap in magnetic material 304 if present, should have a smaller magnetic permeability than that of magnetic material 304. Otherwise, the magnetic coupling between the lines may degrade. For example, the relative permeability of magnetic material 304 may be greater than 100 and the relative permeability of insulator 306 may be close to one.

Forming lines 302 within one layer, as shown in the embodiment of FIGS. 3*a*, 3*b* and 3*c*, reduces the number of metal levels needed, and reduces capacitance between lines 302 when compared to forming lines on top of each other.

Figure 4:
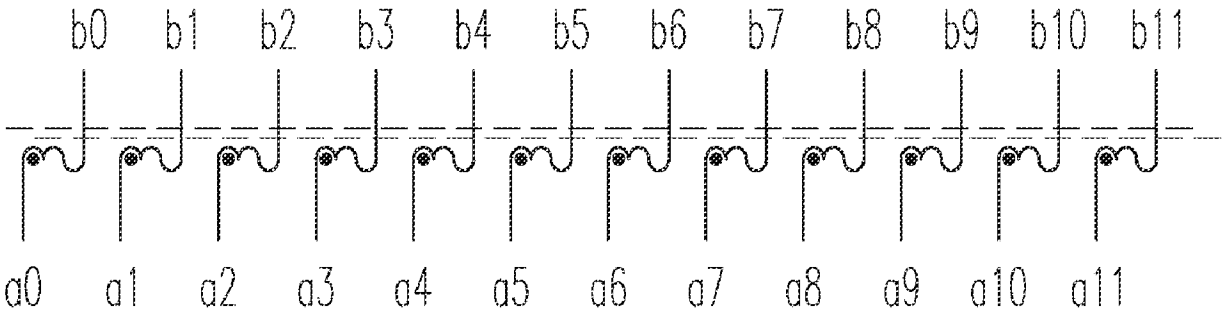
FIG. 4 is a circuit model of the transformer of FIGS. 3*a* and 3*b*.

For simplicity, FIGS. 3*a*, 3*b*, and 3*c* shows only twelve parallel lines, and they do not show the die substrate, other layers, and interconnects. A simplified circuit model for the transformer of FIGS. 3*a* and 3*b* (or the embodiment of 3*c*) is provided in FIG. 4. The magnetic coupling between any two lines decreases with increasing distance between the two lines.

According to embodiments of the present invention, subsets of lines 302 are used to form windings, where the lines belonging to any one subset of lines are connected in parallel to each other. For some embodiments, there is a one-to-one correspondence between a subset and a winding. That is, each subset of parallel connected lines forms a unique transformer winding. For other embodiments, one or more subsets of lines may be connected in series with each other to form a winding of higher inductance. In either case, the windings thereby formed are smaller in number than the number of available lines. The subsets of lines 302 are chosen such that no two lines belonging to any one subset are nearest neighbors. Another way of stating this is that lines that are nearest neighbors belong to different subsets. Two lines are said to be nearest neighbors when there are no other lines in between them.

Figure 5:
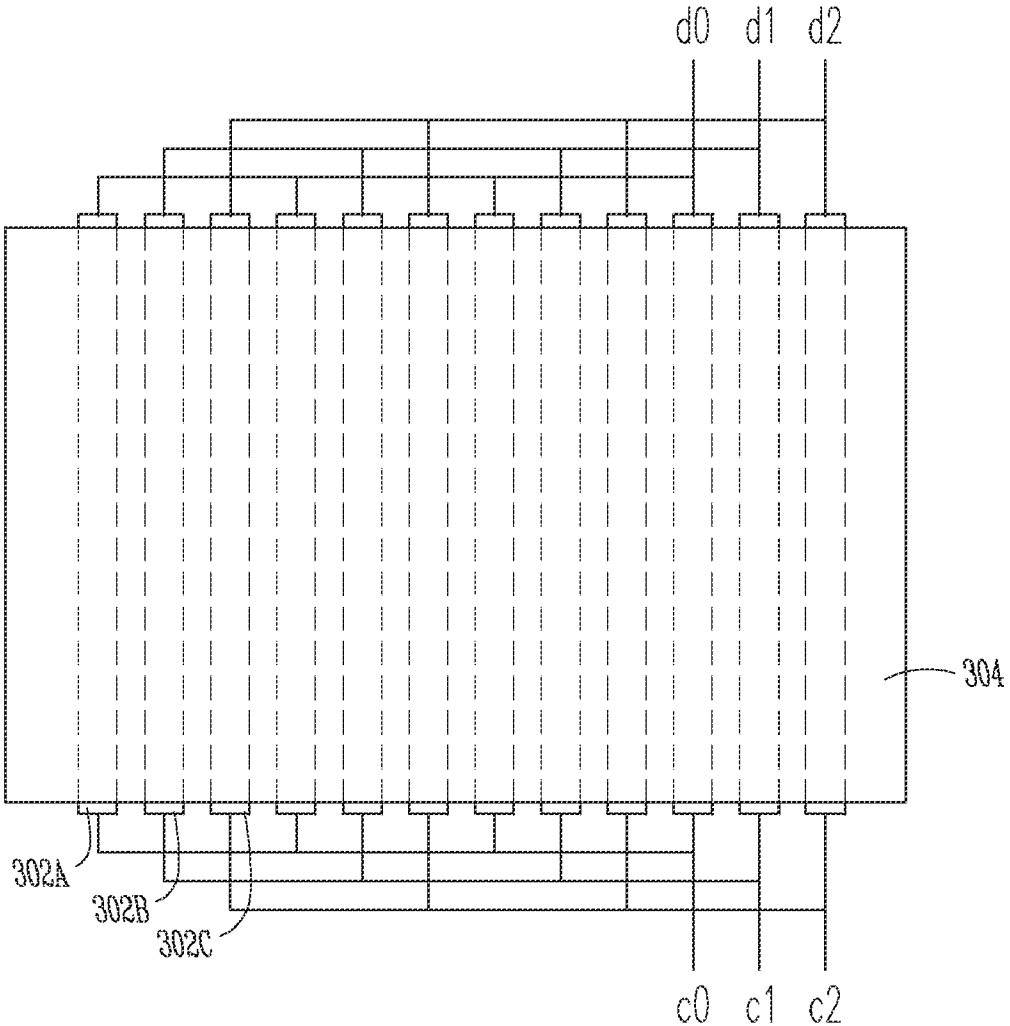
FIG. 5 illustrates connections to realize a transformer with three windings according to an embodiment of the present invention.

As an example of connecting lines to form the windings of a transformer, FIG. 5 provides one example of a transformer having three windings formed from the twelve lines of FIG. 3. A first winding is defined by the path between $d_0$ and $c_0$, a second winding is defined by the path between $d_1$ and $c_1$, and a third winding is defined by the path between $d_2$ and $c_2$. It has been found by simulation that coupling coefficients among any two of the three windings in a transformer according to an embodiment of the present invention may be as high as 95%, and in some cases, higher than 98%, despite the fact that the coupling of any two individual lines may be as poor as 10%. It has also been found that coupling coefficients between any two windings according to an embodiment of the present invention are better when compared to an embodiment utilizing windings formed by connecting in parallel lines that are wider but fewer in number. For example, for a given area, the embodiment of FIG. 5 provides better magnetic coupling than the case in which every four adjacent lines are combined into a wider line, where each wider line forms a winding.

Figure 6:
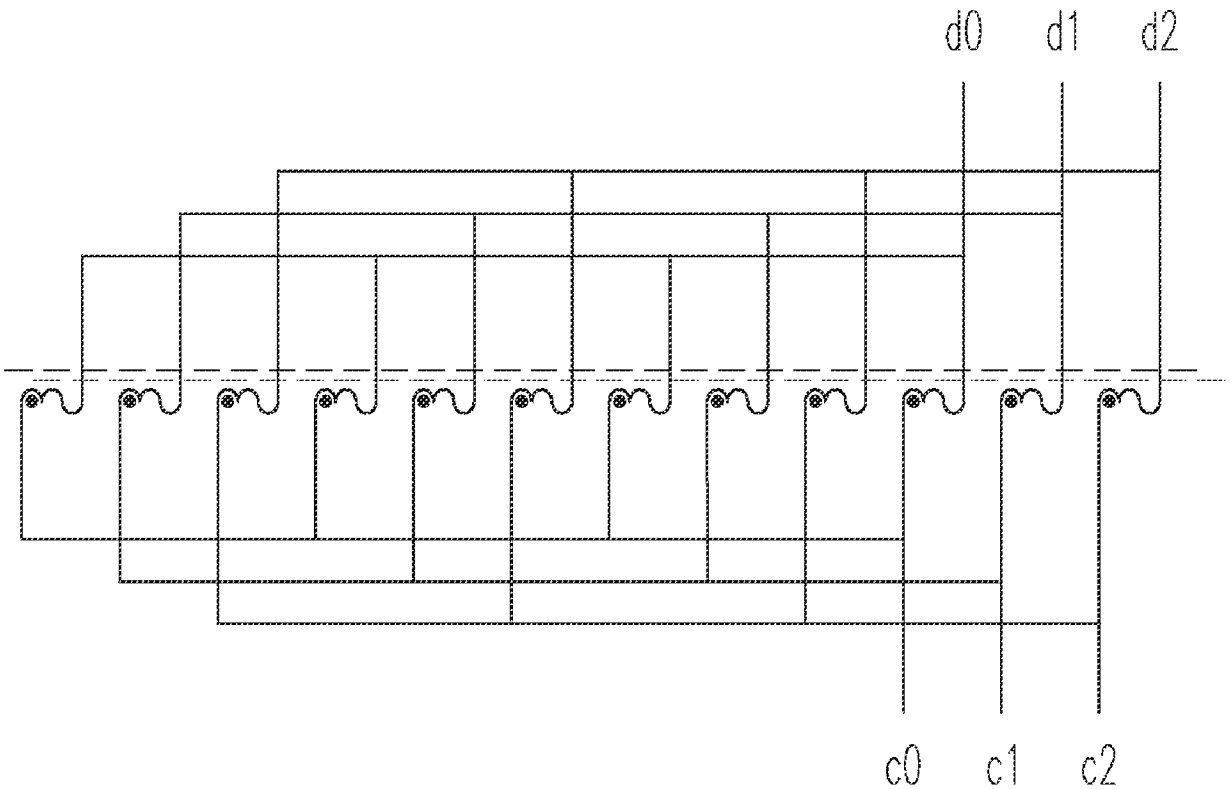
FIG. 6 is a circuit model of the transformer of FIG. 5.

As seen in FIG. 5, the lines are grouped into three subsets, where no two lines belonging to any one subset are nearest neighbors. Each subset corresponds to a unique winding. For example, lines 302*b* and 302*c* in FIG. 5 are nearest neighbors, but they do not belong to the same winding (subset). A simplified circuit model of FIG. 5 is shown in FIG. 6. In particular, every third line in FIG. 5 starting from the leftmost line is connected in parallel to form a first subset, every third line starting from the first line to the right of the leftmost line is connected in parallel to form a second subset, and every third line starting from the second line to the right of the leftmost line is connected in parallel to form a third subset. This approach to choosing subsets of parallel connected lines may be generalized to an arbitrary number of lines as follows: For an arbitrary number of lines $n>1$, denoted as line(i), $i=0, 1, \ldots, n-1$, choose $m>1$ subsets, denoted as subset(j), $j=0, 1, \ldots, m-1$, where for each $i=0, 1, \ldots, n-1$, line(i) belongs to subset(i modulo m), where all the lines in any one subset are connected in parallel to each other.

Note that the latter expression is more narrow than the earlier stated property that no two lines belonging to any one subset are nearest neighbors. That is, if line(i) belongs to subset(i modulo m) for each i, then no two lines belonging to any one subset are nearest neighbors. However, the converse is not necessarily true.

In the case of FIG. 5, $i=12$ and $m=3$, and each subset corresponds to a unique winding. For other embodiments, i and m will assume different values where $m<i$, and some of the subsets may be connected in series to form a winding.

The connections among the various lines making up the windings may be connected by way of another metal layer (not shown) above or below the lines, or may be made by starting and ending the lines on metal pads, and connecting the metal pads among each other by bonding wires or package traces to realize the desired windings.

Various modifications may be made to the disclosed embodiments without departing from the scope of the invention as claimed below. For example, in some embodiments, lines 302 need not be linear or parallel. Furthermore, it is to be understood in these letters patent that the phrase "A is connected to B" means that A and B are directly connected to each other by way of an interconnect, such as metal or polysilicon. This is to be distinguished from the phrase "A is coupled to B", which means that the connection between A and B may not be direct. That is, there may be an active device or passive element between A and B.

What is claimed is:

1. A die comprising a transformer, the transformer comprising windings and comprising a set of lines formed within one layer on the die to form the windings of the transformer, wherein all of the lines that form the windings are physically arranged in parallel with each other, wherein no two lines in the set of lines belonging to any one winding are nearest neighbors, and wherein at least one of the windings is formed from at least two different lines of the set of lines.

2. The die as set forth in claim 1, further comprising magnetic material deposited near the set of lines, wherein the magnetic material is chosen from the group consisting of amorphous CoZrTa, CoFeHfO, CoAlO, FeSiO, CoFeAlO, CoNbTa, CoZr, and other amorphous cobalt alloys.

3. The die as set forth in claim 2, further comprising a controller to operate the transformer at a frequency greater than 10 MHz.

4. The die as set forth in claim 3, the set of lines comprising n>1 lines denoted as line(i), i=0, 1, . . . , n−1, and the transformer comprising m>1 windings denoted as winding (j), j=0, 1, . . . , m−1, wherein line(i) belongs to winding(i modulo m).

5. The die as set forth in claim 1, the set of lines comprising n>1 lines denoted as line(i), i=0, 1, . . . , n−1, and the transformer comprising m>1 windings denoted as winding(j), j=0, 1, . . . , m−1, wherein line(i) belongs to winding(i modulo m).

6. The die as set forth in claim 5, further comprising magnetic material deposited near the set of lines, wherein the magnetic material is chosen from the group consisting of amorphous CoZrTa, CoFeHfO, CoAlO, FeSiO, CoFeAlO, CoNbTa, CoZr, and other amorphous cobalt alloys.

7. The die as set forth in claim 1, further comprising a controller to operate the transformer at a frequency greater than 10 MHz.

8. The die as set forth in claim 2, the set of lines having ends, wherein the magnetic material completely surrounds the set of lines except for the ends of the set of lines.

9. The die as set forth in claim 2, the set of lines having ends and having a rightmost line, wherein the magnetic material completely surrounds the set of lines except for the ends of the set of lines and except for a gap near the rightmost line.

10. A computer system comprising a die and an off-die cache, the die comprising a transformer, the transformer comprising windings and comprising a set of lines formed within one layer on the die, wherein no two lines in the set of lines belonging to any one winding are nearest neighbors, and wherein at least one of the windings is formed from at least two different lines of the set of lines.

11. The computer system as set forth in claim 10, further comprising magnetic material deposited near the set of lines, wherein the magnetic material is chosen from the group consisting of amorphous CoZrTa, CoFeHfO, CoAlO, FeSiO, CoFeAlO, CoNbTa, CoZr, and other amorphous cobalt alloys.

12. The computer system as set forth in claim 11, further comprising a controller to operate the transformer at a frequency greater than 10 MHz.

13. The computer system as set forth in claim 12, the set of lines comprising n>1 lines denoted as line(i), i=0, 1, . . . , n−1, and the transformer comprising m>1 windings denoted as winding(j), j=0, 1, . . . , m−1, wherein line(i) belongs to winding(i modulo m).

14. The computer system as set forth in claim 10, the set of lines comprising n>1 lines denoted as line(i), i=0, 1, . . . , n−1, and the transformer comprising m>1 windings denoted as winding(j), j=0, 1, . . . , m−1, wherein line(i) belongs to winding(i modulo m).

15. The computer system as set forth in claim 14, further comprising magnetic material deposited near the set of lines, wherein the magnetic material is chosen from the group consisting of amorphous CoZrTa, CoFeHfO, CoAlO, FeSiO, CoFeAlO, CoNbTa, CoZr, and other amorphous cobalt alloys.

16. The computer system as set forth in claim 10, further comprising a controller to operate the transformer at a frequency greater than 10 MHz.

17. A die comprising a transformer, the transformer comprising a set of lines formed within one layer on the die to form windings of the transformer, wherein subsets of the set of lines are such that no two lines in any one subset are nearest neighbors; and all of the lines in any one subset belonged to a winding among the windings are physically arranged in parallel with each other, wherein at least one of the windings is formed from at least two different lines of the set of lines.

18. The die as set forth in claim 17, further comprising magnetic material deposited near the set of lines, wherein the magnetic material is chosen from the group consisting of amorphous CoZrTa, CoFeHfO, CoA1O, FeSiO, CoFeA1O, CoNbTa, CoZr, and other amorphous cobalt alloys.

19. The die as set forth in claim 18, the set of lines having ends, wherein the magnetic material completely surrounds the set of lines except for the ends of the set of lines.

20. The die as set forth in claim 18, the set of lines having ends and having a rightmost line, wherein the magnetic material completely surrounds the set of lines except for the ends of the set of lines and except for a gap near the rightmost line.

21. The die as set forth in claim 18, further comprising a controller to operate the transformer at a frequency greater than 10 MHz.

22. The die as set forth in claim 21, the set of lines comprising n>1 lines denoted as line(i), i=0, 1, . . . , n−1, where the subsets are m>1 in number and are denoted as subset(j), j =0, 1, . . . , m−1, wherein line(i) belongs to subset(i modulo m).

23. The die as set forth in claim 17, the set of lines comprising n>1 lines denoted as line(i), i=0, 1, . . . , n−1, where the subsets are m>1 in number and are denoted as subset(j), j =0, 1, . . . , m−1, wherein line(i) belongs to subset(i modulo m).

24. The die as set forth in claim 23, further comprising magnetic material deposited near the set of lines, wherein the magnetic material is chosen from the group consisting of amorphous CoZrTa, CoFeHfO, CoA1O, FeSiO, CoFeA1O, CoNbTa, CoZr, and other amorphous cobalt alloys.

25. The die as set forth in claim 23, further comprising a controller to operate the transformer at a frequency greater than 10 MHz.

26. The die as set forth in claim 17, wherein each subset of lines corresponds to a unique winding.

27. The die as set forth in claim 26, wherein at least two subsets are connected in series with each other to form a winding.

28. The die as set forth in claim 22, the transformer comprising m>1 windings denoted as winding(j), j=0, 1, . . . , m−1, wherein for each j=0, 1, . . . , m−1, winding(j) corresponds to subset(j).

29. The die as set forth in claim 22, the transformer comprising windings, and where there is a r and s with r≠s wherein subset(r) is connected in series with subset(s) to form a winding.

30. A die comprising a transformer, the transformer comprising windings and comprising a set of lines formed within one layer on the die to form the windings of the transformer, wherein no two lines in the set of lines belonging to any one winding are nearest neighbors, and wherein at least one of the windings is formed from at least two different lines of the set of lines.

* * * * *